US008291606B2

(12) United States Patent
Miller

(10) Patent No.: US 8,291,606 B2
(45) Date of Patent: Oct. 23, 2012

(54) GUIDE TOOL AND METHOD FOR LAYING CONCRETE BLOCK

(76) Inventor: Rodney Miller, West Unity, OH (US)

( * ) Notice: Subject to any disclaimer, the term of this patent is extended or adjusted under 35 U.S.C. 154(b) by 0 days.

(21) Appl. No.: 13/065,478

(22) Filed: Mar. 23, 2011

(65) Prior Publication Data

US 2012/0240513 A1 Sep. 27, 2012

(51) Int. Cl.
*G01C 15/06* (2006.01)
*G01C 15/10* (2006.01)

(52) U.S. Cl. ..... 33/409; 33/1 LE

(58) Field of Classification Search ..... 33/404–410
See application file for complete search history.

(56) References Cited

U.S. PATENT DOCUMENTS

| | | | | |
|---|---|---|---|---|
| 2,834,112 | A * | 5/1958 | Seagraves | 33/409 |
| 3,200,500 | A * | 8/1965 | Stone | 33/409 |
| 3,408,742 | A * | 11/1968 | Caprio et al. | 33/409 |
| 5,479,713 | A * | 1/1996 | Wood | 33/407 |
| 6,036,133 | A * | 3/2000 | Milligan | 33/409 |
| 6,412,184 | B1 * | 7/2002 | Heavner | 33/409 |
| 7,409,771 | B2 * | 8/2008 | Bond | 33/409 |
| 7,673,393 | B1 * | 3/2010 | Hudson | 33/409 |
| 7,779,546 | B2 * | 8/2010 | Bond | 33/409 |
| 2007/0089312 | A1 * | 4/2007 | Wade | 33/409 |

* cited by examiner

*Primary Examiner* — Yaritza Guadalupe-McCall

(57) ABSTRACT

A guide tool for use in laying concrete block to form a wall includes a body sized and configured to slidably attach removably to a door frame such as to secure one end of a mason's line at a desired elevation and with a selected offset relative to the door frame. As so secured by the guide tool, the mason's line provides a true positional reference for laying of concrete block both with respect to the intended line of the wall in plan view, and with respect to the desired horizontal line of courses of block which are to form the wall.

12 Claims, 3 Drawing Sheets

GUIDE TOOL AND METHOD FOR LAYING CONCRETE BLOCK

BACKGROUND OF THE INVENTION

1. Field of the Invention

Figure 2:
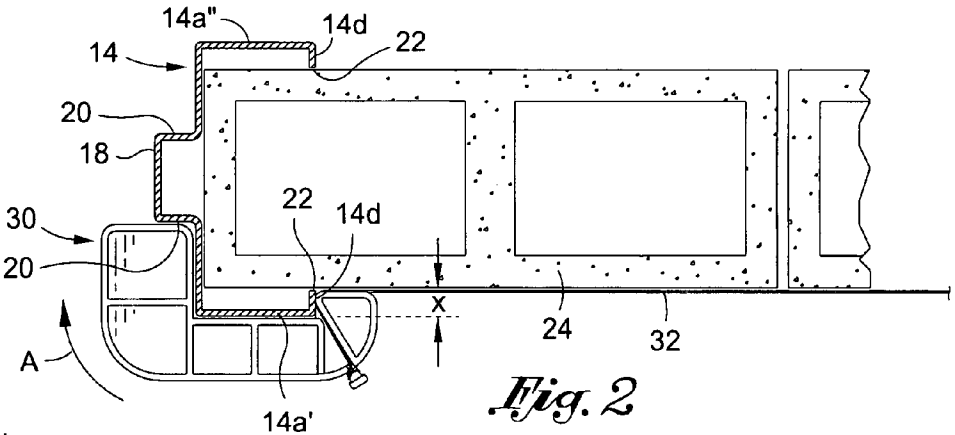

The present invention relates generally to a guide tool for use by a mason while laying block or brick (i.e., concrete block, concrete or clay bricks, or other masonry units) in order to form a section of a concrete block or brick wall (for example) which includes a door frame. Commonly, a door may be hinged in the door frame, and when open provides for passage through the block wall section. Alternatively, the door frame may remain always open (i.e., without a door), thus simply providing for a finished surrounding to an opening in the concrete block wall.

By use of the present inventive guide tool, a block mason is able to more quickly and more accurately lay concrete block or brick adjacent to and with reference to a door frame (i.e., thus forming a particular section of concrete block or brick wall), and to interlock a door frame into the concrete block or brick wall section as the wall is constructed. The guide tool secures one end of a mason's line which is used by the mason as a guide while laying the concrete blocks or bricks. According to one preferred embodiment, the inventive guide tool is sized and configured to be manually engaged with and to retain a selected vertical position on standard sizes of door frames, such that the guide tool may be slid or moved manually upwardly along such a door frame as laying of successive courses of concrete block or brick progresses. According to an alternative embodiment of the present invention, the guide tool is configured to allow its adjustment in order to manually engage upon and retain its position on other sizes and configurations of door frame, while still being slidably adjustable in position upwardly as the laying of concrete block or brick progresses.

2. Related Technology

Presently, when a block mason is to lay a concrete block or brick wall section which will include a door frame, a concrete slab or floor will first have been placed, and the door frame is then attached at a selected location to the slab or floor and plumbed (i.e., made vertical). Following this preparatory work, the block mason then establishes a vertical reference at a distance from the door frame (possibly at a distant corner of the slab or floor). This vertical reference is sometimes commonly referred to as a "truth pole" because it and the door frame are vertical and horizontal references with respect to which the concrete block or brick of the wall are to be laid. In many cases, this truth pole is a vertical member or pole attached to the floor or slab, or driven into the earth, and with one face of the member being truly vertical and in horizontal alignment with one desired face of the concrete block or brick wall to be constructed. Ordinarily, the block mason will stretch a mason's line between the truth pole and the door frame and lay a "lead" of concrete block or brick proceeding from the door frame toward the truth pole. The lead is a triangular arrangement of blocks, each in the proper horizontal and vertical position, and extending from the door frame along the desired line of the concrete block or brick wall to be laid. For example, the first course of the lead may include 8 blocks, while the second course includes 7 and ½ blocks. The next course would then be 6 blocks, followed by a course of 5 and ½ blocks, and so on. As each block of this lead is laid by the mason, the desired offset of the block relative to the mason's line must be established and maintained adjacent to the door frame. That is, the horizontal and vertical alignment of each successive block must be maintained. Otherwise, errors in the resulting block wall will be cumulative, and the wall may wonder off line, or be off of true horizontal. As the concrete block or brick are laid, the door frame is also interlocked with the concrete blocks or bricks using mortar. Using such a lead construction, the wall is laid by progressive extension of the successive block courses, each course having only one or only a few blocks added at a time. The successive concrete blocks or bricks are added to the lead with reference to both the preceding blocks (i.e., to the vertical and horizontal alignment of the lead) and to the mason's line until the block wall is completed.

Importantly, with the use of a lead as described above, the block mason has to apply mortar for the blocks or bricks successively in horizontal and vertical joints as successive blocks or bricks are laid by reference to the vertical and horizontal reference of the lead and mason's line. So, the block wall laying process becomes essentially a two-step alignment process of: (1) laying the lead blocks or bricks adjacent to the door frame by reference to the mason's line, and (2) extending the lead by laying the block or brick in partial courses successively toward the truth pole to complete the wall by reference to the vertical position and horizontal position of the lead and mason's line. And, undesirably, the application of the mortar for the joints between the successive blocks or bricks as the lead is extended must be done successively horizontally and vertically essentially as individual mortar joint sections. Hereinafter, the description of this present invention will refer to concrete block only, as the problems for a mason in laying concrete blocks and bricks are essentially the same.

SUMMARY OF THE INVENTION

In view of the deficiencies of the conventional related technology, it is an object of this invention to overcome or reduce one or more of these deficiencies.

Accordingly, one particularly preferred embodiment of the present invention provides a guide tool which will removably attach movably and in position-holding relation to a door frame in order adjustably vertically position a mason's line relative to a door frame with a desired horizontal offset such that the mason's line is true both to a desired face position of concrete block forming a concrete block wall, and to the horizontal.

Further, such a guide tool allows a block mason to lay an entire course of block extending from a door frame to (or a significant distance toward) a truth pole spaced from the door frame, such that an extended length of horizontal mortar is first laid down, followed by successive blocks of the particular course. Between each successive block of the particular course the mason places vertical mortar. Then, an entire next-successive course of block is laid to (or a significant distance toward) the distant truth pole, after the preparatory placement of an extended length of horizontal mortar. Laying of the concrete block wall progresses in this way. In other words, a lead is not used, and the laying of the wall becomes a one-step alignment process. Also, while vertical mortar placement is still needed for each vertical joint between adjacent blocks of a course, horizontal mortar placement can be done for an entire coarse, or for at least an extended length of each coarse.

It follows that by use of the present inventive guide tool, as the laying of a concrete block wall progresses upwardly from a slab or floor, the guide tool is progressively moved or slid upwardly along the door frame in order to provide a vertical and horizontal reference (in conjunction with a distance truth pole or reference) for laying of the successive courses of the concrete block wall.

Other objects, features, and advantages of the present invention will be apparent to those skilled in the art from a consideration of the following detailed description of two preferred exemplary embodiments thereof taken in conjunction with the associated figures which will first be described briefly.

BRIEF DESCRIPTION OF THE DRAWING FIGURES

Figure 1:
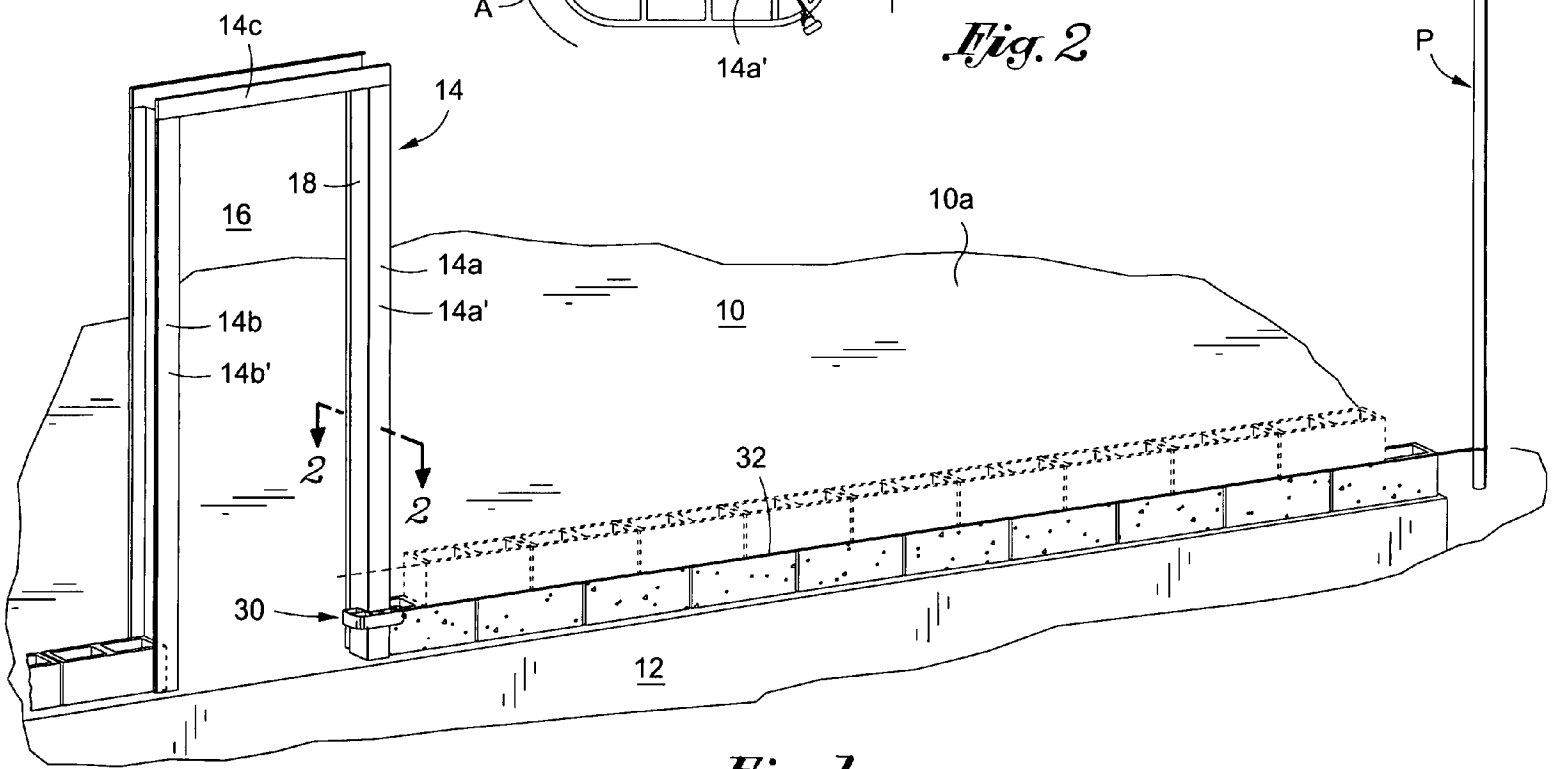
Figure 3:
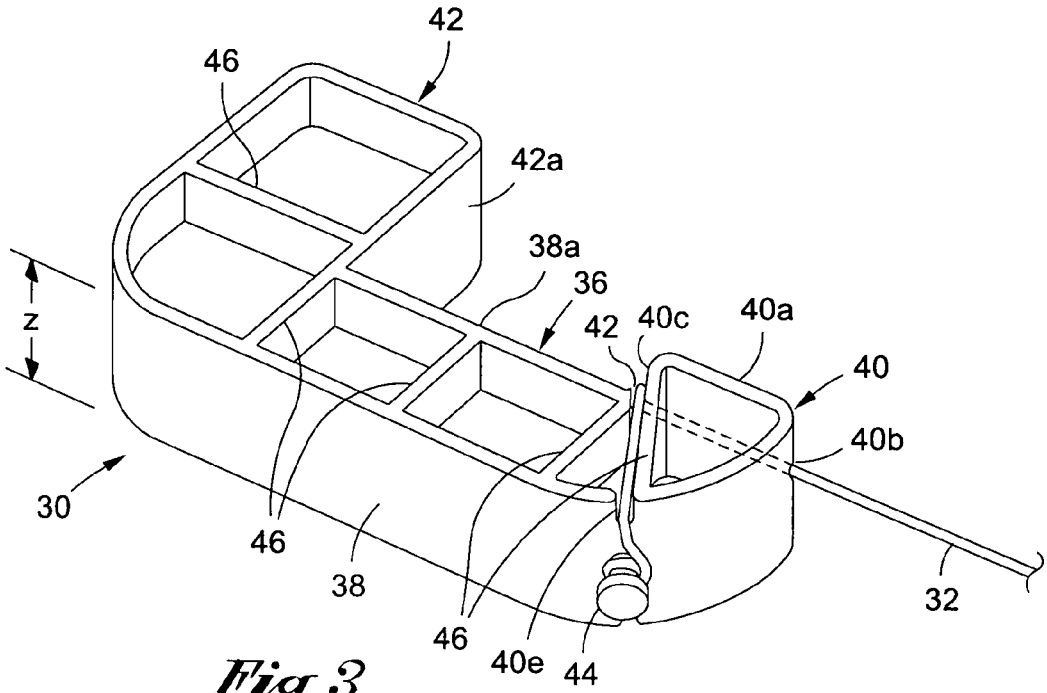
Figure 4:
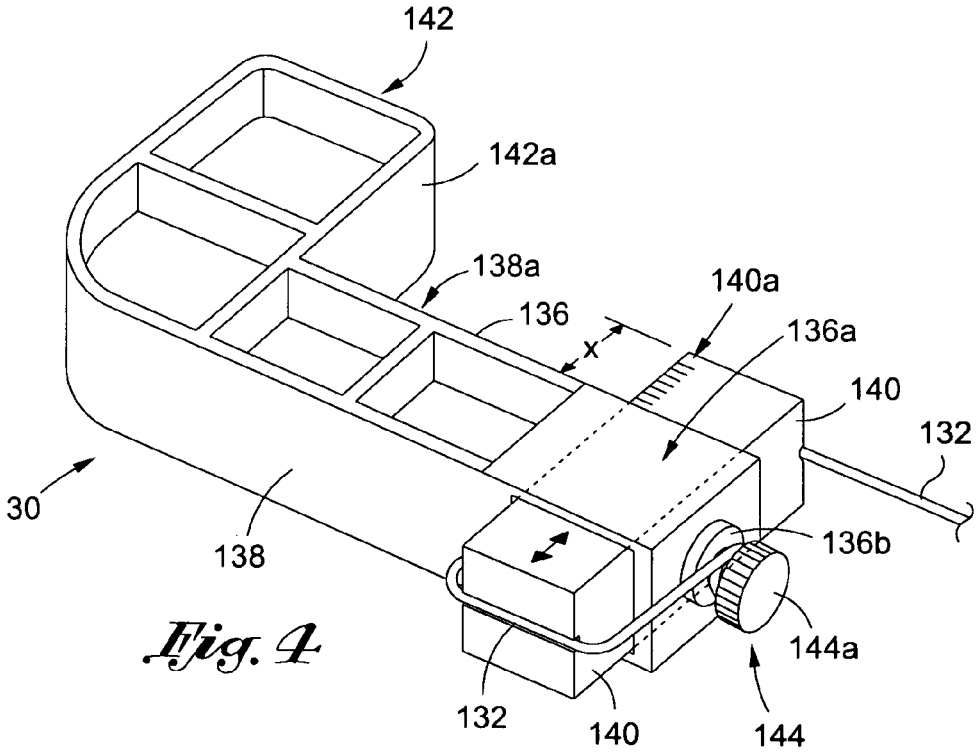
Figure 5:
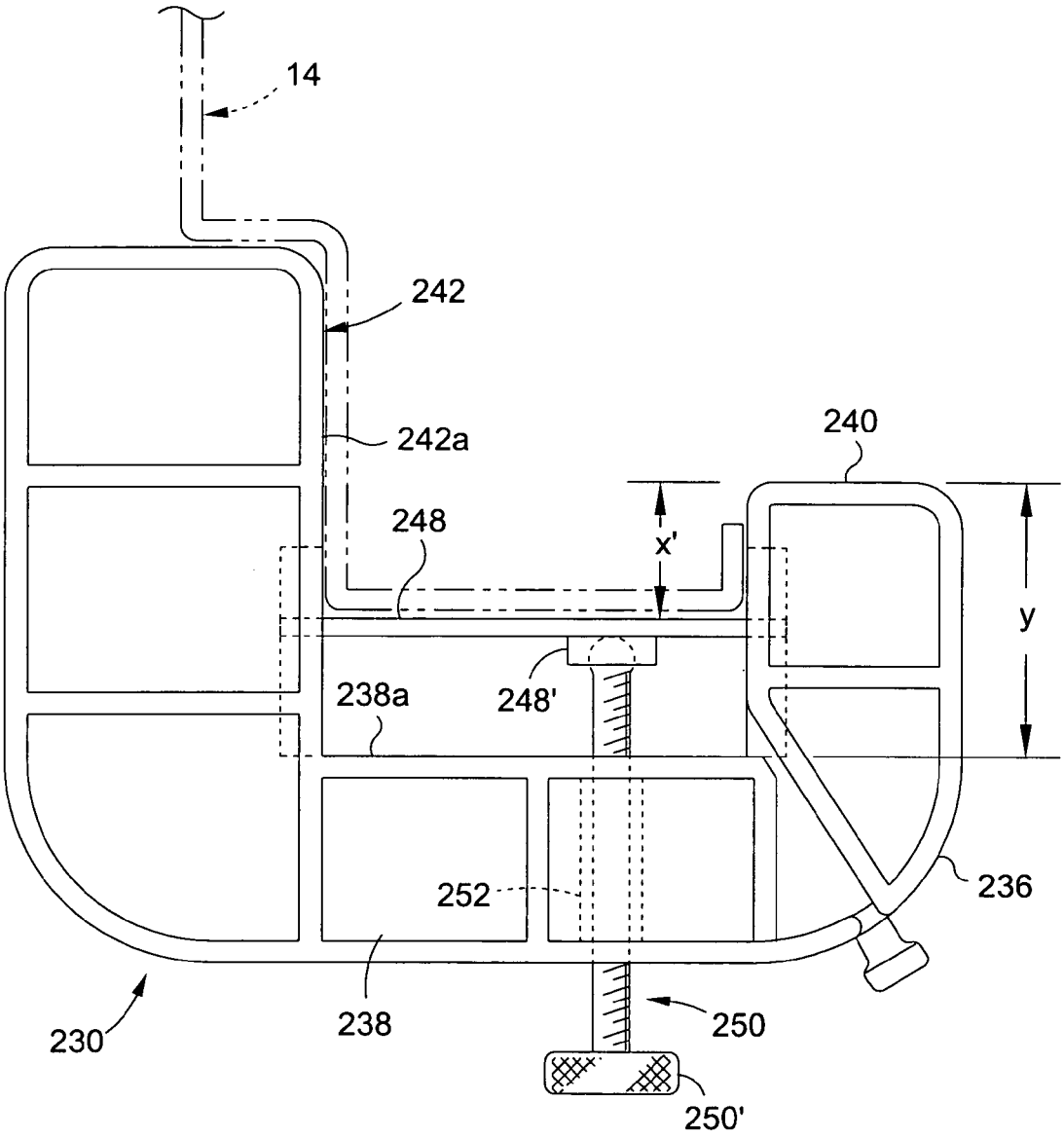

FIG. 1 provides a fragmentary perspective view of a floor or slab upon which a door frame is attached, and to which a concrete block wall is to be laid, and includes a door frame mounted to the slab, and a guide tool according to this present invention securing one end of a mason's line;

FIG. 2 is a fragmentary plan view taken at line 2-2 of FIG. 1;

FIG. 3 provides a perspective view of a guide tool embodying this present invention;

FIG. 4 provides a perspective view similar to that of FIG. 3, but showing an alternative embodiment of guide tool according to this present invention; and FIG. 5 is a perspective view similar to that of FIGS. 3 and 4, but showing yet another alternative embodiment of guide tool according to this present invention.

DETAILED DESCRIPTION OF EXEMPLARY PREFERRED EMBODIMENTS OF THE INVENTION

While the present invention may be embodied in many different forms, disclosed herein are two specific exemplary and preferred embodiment which illustrate and explain the principles of the invention. In conjunction with the description of this embodiment, a method of providing and utilizing a guide tool according to this invention will be apparent. It should be emphasized that the present invention is not limited to the specific embodiments illustrated.

In order to provide a background, or context, for the present invention and its use, attention is directed first of all to FIG. 1, in which a concrete slab 10 has been installed upon the earth 12. The top surface 10*a* of the slab 10 is somewhat elevated above grade level of the earth 12 in this case, which is just an example and by no means limiting of the invention. Typically, the slab 10 will have constructed upon it a building or other structure. As is seen in FIG. 1, a doorframe 14 has been attached atop of the slab 10 at surface 10*a* near an edge of the slab. The doorframe 14 perhaps is intended to receive a door (not seen in the drawing Figures) which will provide control of ingress and egress from the structure to be constructed upon slab 10 (i.e., via a door frame opening 16). The doorframe 14 consists of a pair of door jambs 14*a*, 14*b*, connected proximate to their top extents by a head 14*c*. The door jambs 14*a*, 14*b* each define a face indicated with the numerals 14*a*' and 14*b*', which are disposed toward the viewer of FIG. 1, and away from the slab 10 in this case. The faces 14*a*', 14*b*' have been made plumb, or truly vertical. The doorframe 14 also includes inside faces 14*a*" and 14*b*" on the side away from the viewer of FIG. 1 (as is best seen in FIG. 2). Between the faces of the doorframe and within the door opening 16, the doorframe 14 includes a soffit 18 which protrudes into the opening 16 in order to provide a pair of stops 20, best seen in FIG. 2. The stops provide for a door (not seen in the drawing Figures), which when hinged in the door frame 14 at opening 16, to engage one of the stops 20 in the closed position of the door. The doorframe 14 need not receive a door, but may be left open as a portal through the block wall to be constructed, as is further explained below.

Importantly, viewing FIG. 2 it is seen that the door frame 14 also includes relatively short return sections 14*d*, and that these returns between them cooperatively define a throat 22, which is sized to receive a portion of adjacent concrete blocks 24 (along with securing mortar—the mortar not being shown in the drawing Figures). As a result, as the blocks 24 are laid, the door frame 14 is interlocked with the concrete block wall including the blocks 24 and the mortar securing these blocks together. Viewing FIG. 2, it is seen by use of a dotted line that (hypothetically) should a mason's line be extended (as is conventional) from the face 14*a*' to a truth pole "P" (with the truth pole "P" in this hypothetical explanation being offset to match the distance of face 14*a*' from the intended line of the blocks 24 in plan view) then the mason's line would be parallel to but would not be at the true intended line of the face of the concrete blocks and would be off set a distance "x." And, consequently, a block mason in laying the successive blocks 24 would have to measure, judge, or guess at this distance "x" with each block laid. Should the mason misjudge or mistakenly measure this distance "x," then the block wall may wonder off line, and may not be true (i.e., along an intended line in plan view). That is, cumulative positional errors of the successive blocks may also, and these errors may be in the horizontal direction, in the vertical direction, or both. Understandably, with such abundant opportunity for additive or cumulative positional errors of each successive block laid, block walls which have been laid by a less than expert block mason frequently look exactly like they were laid by an amateur. For this reason, and others, block masonry is a highly skilled trade. In addition to the opportunity for error implicit in this conventional method of laying a block wall, the use of a lead, as explained earlier, although used in an attempt to reduce such errors, also costs the block mason valuable time and makes the blocks slower to lay.

Now, viewing FIGS. 1 and 2 in conjunction, it is seen that a guide tool 30 according to this invention is in use at the door frame 14 in order to establish a mason's line 32 which is truly along the intended line of the block wall (i.e., along one face of the block wall in plan view—as is seen in FIG. 2). That is, the guide tool 30 has built into it a desired offset "x" according to the particular door frame 14 being installed into a block wall under construction. With a standard door frame 14 being used, the offset "x" is preferably ⅜ inch. In this case, the edge of the truth pole "P" about which the line 32 is secured is placed true in plan view to the intended line of the block wall to be laid. Also, as is seen in FIG. 1, the mason's line 32 is set true to the horizontal line desired for a particular course of block. As thus set or prepared, the block mason is able to place all or a significant length of the horizontal mortar for a course of block, extending from the door frame 14 toward the truth pole "P." With the horizontal mortar thus laid, the block mason is then able to lay all or a significant part of the blocks for a horizontal course of blocks, interlocking the first block with the door frame 14 (i.e., into throat 22 with securing mortar) and proceeding toward the truth pole "P." With each block laid, the block mason need only place the vertical mortar between adjacent blocks of a course, and uses the line 32 to establish the true position of the block face in plan view (see FIG. 2), and the true position of the block top edge in elevation view (see FIG. 1). Thus, importantly, a lead preferably is not used when using a guide tool 30 according to this invention, and the block 24 can be laid both more quickly, and with far less chance of error.

Once a course of block is completed, the block mason slides the guide tool 30 (and the attached end of mason's line 32) upwardly along door frame 14 by a distance equal to the height of the block 24 being used plus the mortar thickness desired for the horizontal block joints. As will be explained, the guide tool movably and retainingly engages the door frame 14 so that it will retain a desired vertical position along this door frame. An equivalent adjustment is made to the mason's line position at the truth pole "P." Thus, the mason's line 32 is maintained truly horizontal, and provides a horizontal reference along its length for the thickness of the horizontal mortar joints the block mason is to form between adjacent blocks as they are laid. Again, importantly, as thus prepared, the block mason is again able to place all or a significant length of the horizontal mortar for a course of block, extending from the door frame 14 toward the truth pole "P." With the horizontal mortar thus laid, the block mason is then able to lay all or a significant part of the blocks for a horizontal course of blocks, needing only to place the mortar for the vertical joints as he places each block, and then truing (i.e., by tapping the block with his trowel handle) the block position (i.e., both horizontally and vertically) according to the immediately adjacent mason's line 32. The block mason need not measure, judge, or guess at any positional offset "x," nor does the block mason need to construct a lead in an attempt to extend from the door frame 14 true positional accuracy for the successive blocks 24 to be laid toward the truth pole "P."

Having observed the method of use of the guide tool 30, attention may now be directed to the structure of a particularly preferred embodiment of this tool by viewing FIGS. 2 and 3 in conjunction. The embodiment of guide tool illustrated in FIGS. 2 and 3 is illustrative or exemplary only, and is not limiting of the invention. Viewing FIG. 3, it is seen that guide tool 30 includes a body 36 most preferably formed of engineering thermoplastic. That is, the body 36 is most preferably formed of a material that has a selected and desired elasticity, or yieldability or "springiness," while still being shape retaining. The reason for this preferred "spring" in the guide tool 30 will become apparent in view of the structure and use of the guide tool 30, as is further explained below.

Viewing FIG. 3 in particular, it is seen that the guide tool 30 is somewhat C-shaped in plan view, and includes a beam section 38 extending along and engaging at a surface portion 38*a* thereof against the face 14*a*' of the door frame 14, recalling FIG. 2. From opposite ends of the beam section 38 extend respective legs 40 and 42, with the leg 42 preferably being long enough to seat at a surface portion 42*a* adjacent to a stop 20 and adjacent to the soffit 18, again viewing FIG. 2. The leg 40, on the other hand, is comparatively short, and at a surface portion 40*a* thereof has an offset distance "x" from the face 38*a*, recalling FIG. 2. Along this surface 40*a* extends a mason's line groove 40*b*, which is partially visible in FIG. 3. From the left end of the groove 40*b*, as viewed in FIG. 3, extends a diagonal groove 40*c*, again partially visible in FIG. 3, and opening on the upper edge of the guide tool 30. A guide notch 42 provides for the mason's line 32 to be trained along notch 40*b*, groove 40*c*, and guide notch 42 to be secured by wrapping or tying, for example, to a knob 44. As explained earlier, the mason's line 32 extends preferably to a truth pole "P," recalling FIG. 1.

Most preferably, the legs 40 and 42 of the guide tool 30 are not quite parallel, but converge slightly toward one another as they extend from the beam section 38. At the free ends of the legs 40, 42, the spacing between these legs is slightly less than the size of the face 14*a* of the door frame 14. The convergence of the legs 40, 42 along with the springiness of the preferred material from which the guide tool 30 is fashioned allows a block mason to first engage the leg 40 with a jam 14*a* of a door frame 14 beyond the face 14*a*' at return 14*d* (see FIG. 2), and to then pivot the guide tool 30 clockwise, as is indicated by an arcuate arrow "A" in FIG. 2, so that the guide tool 30 "snaps" into engagement on the jam 14*a* of door frame 14 as is shown in FIG. 2. As so engaged upon the door frame 14, the guide tool 30 will retain a selected vertical position along the jam 14*a*, but may be manually slid forcefully upwardly or downwardly to adjust its position (e.g., and the position of mason's line 32). In other words, the guide tool 30 is removably attachable to the door frame 14, and once attached as shown will hold its vertical position on this door frame in order to position the mason's line 32. But, the guide tool 30 may also be forcefully slid along the door frame (i.e., upwardly) as the successive courses of concrete blocks are laid in order to provide successive horizontal and vertical reference positions for the mason's line 32. The block mason makes corresponding positional adjustments of the mason's line at the pole P, as successive courses of blocks are to be laid.

Most preferably, the guide tool 30 is formed with a vertical thickness, so as to extend a distance "Z" along the door frame 14, which distance Z may be preferably in the range from about 1 inch to about 2 inches. This degree of extension of the guide tool 30 along the door frame 14 both provides stability for the guide tool and insures that it has a sufficient grip upon the door frame so that it retains a selected vertical position as selected by the block mason. Further, as is seen in FIGS. 2 and 3, the guide tool 30 preferably has an I-shape or an H-shape in cross section, with plural reinforcing ribs, each generally referenced with an arrowed lead line and the numeral 46. This nature of construction for the guide tool 30 provides both for a considerable savings in the materials of construction, but also for the selection during design of the guide tool in the degree and stiffness of the resilience of the tool. Thus, the guide tool 30 may be made to be a secure "snap" fit upon the door frame 14.

Turning now to FIG. 4, an alternative embodiment of a guide tool according to this invention is illustrated. Because the guide tool illustrated in FIG. 4 has many features in common with that of FIGS. 1-3, features which are the same or which are analogous in structure or function are indicated on FIG. 4 using the same numeral used with reference to the embodiment of FIGS. 1-3, and increased by one-hundred (100).

Viewing FIG. 4, a guide tool 130 according to this invention includes a body 136 preferably formed of a shape-retaining but somewhat yieldable engineering thermoplastic. A beam section 138 is provided for extending along and engaging at a surface portion 138*a* thereof against the face 14*a*' of a door frame 14, recalling the explanation above of how a guide tool according to this invention is utilized by a block mason. Again, from one opposite end of the beam section 138 extends a respective 142, with this leg 142 (like the leg 42) preferably being long enough to seat at a surface portion 142*a* thereof upon the soffit 18 of a door frame 14.

On the other hand, in this embodiment, the body 136 defines a socket portion 136*a* providing for slideably (i.e., movably or adjustably) receiving a movable leg part 140. Leg part 140 is provided with appropriate grooves (not numbered on the drawing Figures) providing for training a mason's line about this leg part. The socket is provided with a threaded boss 136*b* receiving a thumb screw 144 having a head portion 144*a* which serves as a post to which a mason's line 132 may be secured at one end portion, as is illustrated in FIG. 4. The movable leg part 140 is provided with a measuring index, indicated with arrowed numeral 140*a*, by which the projection of this leg part beyond the surface 138*a* may be set. The adjustable position or projection of the leg part 140 beyond surface 138*a* may be locked and retained by manually tightening the thumb screw 144. Accordingly, a variable offset distance "X" from the face 138*a* (which engages upon face 14*a*' of a door frame), recalling FIG. 2, may be set by a block mason using the guide tool 130 of FIG. 4. This adjustability of the guide tool 130 allows a block mason to adjust the line of a block wall when using blocks of a different size or when using a door frame with a throat dimension which is thicker in the side-to-side direction than the blocks being laid. Thus, the projection of the door frame relative to the concrete block wall being laid may be adjusted as desired.

FIG. 5 illustrates yet another alternative embodiment of a guide tool according to this invention. Because the guide tool illustrated in FIG. 5 has many features in common with the two embodiments illustrated earlier described above, features which are the same, or which are analogous in structure or function, to features of the first two embodiments are indicated on FIG. 5 using the same numeral used above, and increased by two-hundred (200).

Viewing FIG. 5, a guide tool 230 embodying the present invention includes a body 236 preferably formed of a shape-retaining but somewhat yieldable engineering thermoplastic. A beam section 238 is provided for extending along but spaced away from engagement against the face 14*a*' of a door frame 14, recalling the explanation above of how a guide tool according to this invention is utilized by a block mason. From opposite ends of this beam section 238 extends respective legs 240 and 242. Again, the leg 242 preferably is long enough to seat at a surface portion 242*a* upon the soffit 18 (recalling again FIG. 2). The leg 240, on the other hand, is comparatively shorter than leg 242, but in this embodiment is about ¾ inch longer than the leg 40 of the first embodiment of the invention. At a surface portion 240*a* thereof the leg portion 240 has an offset distance "Y" from the face 238*a* of about one inch or a little longer, recalling that the embodiment of FIG. 2 had a constant offset distance "x" of about ⅜ inch.

In order to provide for adjustment of a variable offset distance, in this embodiment indicated with the character X' on FIG. 5, this embodiment includes a movable wall member 248 which is shaped like a clevis at each end so that it engages upon and cannot rotate between the walls 240, 242. In other words, the movable wall member 248 slides along the length of the walls 240, 242 and between these walls, as will be explained. The wall member 248 is movably positioned by a thumb screw 250 threadably passing through a boss 252 formed in the web of body 238 intermediate of the legs 240, 242, and having a head portion 250'. The thumb screw 250 at its distal end adjacent to wall 248 includes a ball end (not visible in the drawing Figures) which snaps rotationally into a socket 248' formed on the back side of the wall member 248. Thus, the wall member is adjustably positionable to define a selectively variable offset distance X'. As explained earlier, the leg 240 has notches and a knob 244 for training and securing a mason's line to the guide tool 230. The use of the guide tool 230 is the same as that described above by reference to the embodiment of FIG. 4, except that this particular embodiment has a different structure for obtaining an adjustable position of a mason's line relative to the frame of a door frame.

Those skilled in the art will further appreciate that the present invention may be embodied in other specific forms without departing from the spirit or central attributes thereof. Because the foregoing description of the present invention discloses only particularly preferred exemplary embodiments of the invention, it is to be understood that other variations are recognized as being within the scope of the present invention. Accordingly, the present invention is not limited to the particular embodiments which have been described in detail herein. Rather, reference should be made to the appended claims to define the scope and content of the present invention.

I claim:

1. A guide tool for use by a mason in laying concrete blocks or bricks to form a wall which includes a door frame having a vertical door frame jam, said guide tool being configured especially for slidably movable and position-retaining snap-fit manual attachment to the jam of the door frame in order to proximally position a span of mason's line, said guide tool comprising a body sized and configured to removably embrace and slidably attach by snap-fit engagement to a door frame jam for position-retaining on the door frame even in the absence of tension in the mason's line, and for manual forceful movement vertically along the door frame jam, and further said guide tool providing for securing said mason's line relative to said door frame jam at a desired position both of selected elevation and also in plan view with a selected horizontal offset of the mason's line relative to a face of the door frame jam, whereby the mason's line when secured at the door frame jam via said guide tool at the proximal end of a span of mason's line and at a distal end being secured to truly vertical "truth pole" having a desired location in plan view said span of mason's line provides a true positional reference in both elevation and plan-view for laying of concrete block or brick in a course extending from said door frame toward said truth pole, both with respect to an intended line of the wall in plan view, and with respect to the desired horizontal line of a course of block or brick forming the wall.

2. The guide tool of claim 1, wherein said tool includes a body having a beam structure including a central beam portion for extending along a face of a door jam, and a pair of leg portions extending from said central beam portion substantially parallel to one another in spaced apart relation, a first of said leg portions being configured to engage upon a soffit of said door jam, and a second of said legs being configured to engage upon a stop of said door jam.

3. The guide tool of claim 2 wherein said pair of leg portions converge slightly as they extend from said central beam portion, whereby said guide tool is configured for a position-retaining "snap" fit upon said door jam, with said first leg portion slidably engaging said soffit and said second leg portion slidably engaging said stop.

4. The guide tool of claim 3, said second leg further includes a structure for guiding a mason's line from a securing feature of said guide tool into said desired position.

5. The guide tool of claim 3 wherein said structure for guiding said mason's line includes a first guide notch defined centrally at an end surface of said second leg portion so as to receive and position said mason's line, and a second guide notch extending in communication with said first notch toward said securing feature.

6. A guide tool for use by a mason in laying concrete blocks or bricks to form a wall which includes a door frame having a vertical door frame jam, said guide tool being configured especially for slidably movable and position-retaining manual attachment to the jam of the door frame in order to proximally position a span of mason's line, said guide tool comprising a body sized and configured to removably embrace and slidably attach to a door frame jam for manual forceful movement vertically along the door frame jam, and further said guide tool providing for securing said mason's line relative to said door frame jam at a desired position both of selected elevation and also in plan view with a selected horizontal offset of the mason's line relative to a face of the door frame jam, whereby the mason's line when secured at the door frame jam via said guide tool at the proximal end of a span of mason's line and at a distal end being secured to truly vertical "truth pole" having a desired location in plan view said span of mason's line provides a true positional reference in both elevation and plan-view for laying of concrete block or brick in a course extending from said door frame toward said truth pole, both with respect to an intended line of the wall in plan view, and with respect to the desired horizontal line of a course of block or brick forming the wall;

wherein said tool includes a body having a beam structure including a central beam portion for extending along a face of a door jam, and a pair of leg portions extending from said central beam portion substantially parallel to one another in spaced apart relation, a first of said leg portions being configured to engage upon a soffit of said door jam, and a second of said legs being configured to engage upon a stop of said door jam;

wherein said pair of leg portions converge slightly as they extend from said central beam portion, whereby said guide tool is configured for a position-retaining "snap" fit upon said door jam, with said first leg portion slidably engaging said soffit and said second leg portion slidably engaging said stop;

wherein said structure for guiding said mason's line includes a first guide notch defined centrally at an end surface of said second leg portion so as to receive and position said mason's line, and a second guide notch extending in communication with said first notch toward said securing feature;

wherein said second leg portion is configured for horizontal adjustable positioning relative to a remainder of said guide tool, whereby said horizontal offset of said mason's line is variable by adjustment of position of said end surface of said second leg portion relative to said central beam portion of said guide tool.

7. The guide tool of claim 6 wherein said central beam portion carries at one end thereof opposite to said first leg portion a socket for adjustably receiving an adjustable leg member forming said second leg portion of said guide tool, and said socket including means for adjustably retaining said leg member in a selected position of extension relative to said central beam portion of said guide tool.

8. A guide tool for use by a mason in order to proximally position a span of mason's line by movable attachment to a door frame jam, said guide tool comprising:

a body sized and configured to removably embrace and slidably attach to a door frame jam for manual forceful movement vertically along the door frame jam, and further said guide tool providing for securing said mason's line relative to said door frame jam at a desired position both of selected elevation and also in plan view with a selected horizontal offset of the mason's line relative to a face of the door frame jam, comprising a guide tool body having a beam structure including a central beam portion for extending along a face of a door frame jam, and a pair of leg portions extending from said central beam portion substantially parallel to one another in spaced apart relation, a first of said leg portions being configured to engage upon a soffit of said door frame jam, and a second of said legs being configured to engage upon a stop of said door frame jam, and wherein said pair of leg portions converge slightly as they extend from said central beam portion, whereby said guide tool is configured for a position-retaining "snap" fit upon said door frame jam, with said first leg portion slidably engaging said soffit and said second leg portion slidably engaging said stop.

9. The guide tool of claim 8, said second leg further includes a structure for guiding a mason's line from a securing feature of said guide tool into said desired position.

10. The guide tool of claim 9 wherein said structure for guiding said mason's line includes a first guide notch defined centrally at an end surface of said second leg portion so as to receive and position said mason's line, and a second guide notch extending in communication with said first notch toward said securing feature.

11. A guide tool for use by a mason in order to proximally position a span of mason's line by movable attachment to a door frame jam, said guide tool comprising:

a body sized and configured to removably embrace and slidably attach to a door frame jam for manual forceful movement vertically along the door frame jam, and further said guide tool providing for securing said mason's line relative to said door frame jam at a desired position both of selected elevation and also in plan view with a selected horizontal offset of the mason's line relative to a face of the door frame jam, comprising a guide tool body having a beam structure including a central beam portion for extending along a face of a door frame jam, and a pair of leg portions extending from said central beam portion substantially parallel to one another in spaced apart relation, a first of said leg portions being configured to engage upon a soffit of said door frame jam, and a second of said legs being configured to engage upon a stop of said door frame jam, and wherein said pair of leg portions converge slightly as they extend from said central beam portion, whereby said guide tool is configured for a position-retaining "snap" fit upon said door frame jam, with said first leg portion slidably engaging said soffit and said second leg portion slidably engaging said stop;

said second leg further including a structure for guiding a mason's line from a securing feature of said guide tool into said desired position;

wherein said structure for guiding said mason's line includes a first guide notch defined centrally at an end surface of said second leg portion so as to receive and position said mason's line, and a second guide notch extending in communication with said first notch toward said securing feature;

wherein said second leg portion is configured for horizontal adjustable positioning relative to a remainder of said guide tool, whereby said horizontal offset of said mason's line relative to said face of said door frame jam is variable by adjustment of position of said end surface of said second leg portion relative to said central beam portion of said guide tool.

12. The guide tool of claim 11 wherein said central beam portion carries at one end thereof opposite to said first leg portion a socket for adjustably receiving an adjustable leg member forming said second leg portion of said guide tool, and said socket including means for adjustably retaining said leg member in a selected position of extension relative to said central beam portion of said guide tool.

* * * * *